US008944435B2

(12) United States Patent
Kolb

(10) Patent No.: US 8,944,435 B2
(45) Date of Patent: Feb. 3, 2015

(54) TABLE/PARLOUR FOOTBALL

(76) Inventor: Justin Kolb, Castle Rock, CO (US)

( * ) Notice: Subject to any disclaimer, the term of this patent is extended or adjusted under 35 U.S.C. 154(b) by 203 days.

(21) Appl. No.: 13/567,009

(22) Filed: Aug. 3, 2012

(65) Prior Publication Data

US 2013/0032997 A1 Feb. 7, 2013

Related U.S. Application Data

(60) Provisional application No. 61/515,551, filed on Aug. 5, 2011.

(51) Int. Cl.

| | |
|---|---|
| ***A63F 7/06*** | (2006.01) |
| ***A63F 7/07*** | (2006.01) |
| ***A63F 7/20*** | (2006.01) |
| ***A63F 3/00*** | (2006.01) |

(52) U.S. Cl.

CPC ..... *A63F 3/0052* (2013.01); *A63F 3/00031* (2013.01); *A63F 2003/00034* (2013.01); *A63F 2003/00287* (2013.01)

USPC ..... 273/317.5; 273/108.4; 273/108.41

(58) Field of Classification Search

CPC ..... A63F 3/0052; A63F 3/00041

USPC ..... 273/317.5, 108.4, 108.41, 288–291; 473/10; 116/225

See application file for complete search history.

(56) References Cited

U.S. PATENT DOCUMENTS

| | | | | | |
|---|---|---|---|---|---|
| 1,693,277 | A | * | 11/1928 | Hustwick | 273/317.5 |
| 2,140,193 | A | * | 12/1938 | Weinberger | 273/317.5 |
| 2,727,744 | A | * | 12/1955 | Watson | 473/588 |
| 2,760,776 | A | * | 8/1956 | Tullio | 273/317.5 |
| 3,379,441 | A | * | 4/1968 | Feather et al. | 473/570 |
| 3,554,548 | A | * | 1/1971 | Isom | 273/247 |
| 3,690,668 | A | * | 9/1972 | Weeks et al. | 273/138.1 |
| 3,724,852 | A | * | 4/1973 | Payne, Jr. | 273/247 |
| 3,784,204 | A | * | 1/1974 | Felber | 473/588 |
| 3,817,529 | A | * | 6/1974 | Dobbins | 273/126 R |
| 5,733,213 | A | * | 3/1998 | Colarusso | 473/588 |
| 6,899,331 | B1 | * | 5/2005 | Beyazbayrak | 273/239 |
| 2006/0055106 | A1 | * | 3/2006 | Cohen | 273/108.1 |
| 2011/0148036 | A1 | * | 6/2011 | Nolen | 273/127 R |

* cited by examiner

*Primary Examiner* — Sebastiano Passaniti

(74) *Attorney, Agent, or Firm* — Faegre Baker Daniels LLP

(57) ABSTRACT

A football game and football game apparatus that consists of sliding football shaped playing pieces down a rectangular planar playing surface towards scoring targets. The scoring targets represent certain yardages that can be gained or lost, or other events that may occur in an American football game, and by which a player can advance or move back their game piece on a simulated football field. The football field is secured perpendicularly across and above the planar playing surface and includes yardage markers, down markers, score trackers, and a line of scrimmage indicator in order to track the game play.

16 Claims, 10 Drawing Sheets

TABLE/PARLOUR FOOTBALL

CROSS-REFERENCE TO RELATED APPLICATIONS

This application claims the benefit of U.S. Provisional Application No. 61/515,551, filed on Aug. 5, 2011.

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

INCORPORATION-BY-REFERENCE OF MATERIAL SUBMITTED ON A COMPACT DISC

Not applicable.

BACKGROUND OF THE INVENTION

1. Field of the Invention

The invention relates generally to tabletop sporting games, parlour games, and recreational/leisure games that involve a combination of skill and luck. More specifically, whereas there are certain parlour games that attempt to recreate the likeness of ice hockey (air hockey) and soccer (foosball), this invention is intended to apply the basic strategy of American football to a tabletop or parlour game.

2. Background Art

In addition, other inventions such as U.S. Pat. No. 5,570,888, U.S. Pat. No. 1,145,955, and U.S. Pat. Application No. 20110031691 contemplate utilizing and manipulating various mechanical devices, figures, and/or playing pieces on a simulated American football field playing surface in an attempt to interact with and advance a football game piece across the field of play in an effort to simulate the game of American football, or U.S. Pat. No. 7,775,525 considers a user tossing objects through targets on an interchangeable board (with overlaying templates representing various sports) with the goal of scoring points or other metrics related to the given sport on the board. The present invention, however, is designed based on American football and utilizes a long and smooth wooden table, on which players slide a football-shaped, metal and plastic playing piece ("puck") towards a scoring zone in which there are targets marked with combinations of yardage gain, yardage loss, or turnover scoring indicators. An attached, simulated American football field playing surface is employed as a yard-marking, scoring, and down-marking device.

BRIEF SUMMARY OF THE INVENTION

The present invention combines the enjoyment and ease found in other parlour games such as billiards, shuffleboard, foosball, and air hockey with the strategy of American football. The objective of the game is to slide a football-shaped puck down a long, smooth wooden planar surface game board, that may be covered in felt or other similar material, into a scoring zone in which there are targets marked with various "points" that equate to yardage gained or lost on the turn, or "down". As the players tally yards on attempts, the down, yardage gained or lost, position on the field, and score are tracked on a simulated American football field playing surface which is secured on top of the game board so that the game pieces may pass underneath.

BRIEF DESCRIPTION OF THE SEVERAL VIEWS OF THE DRAWINGS

Referring now to the drawings.

DETAILED DESCRIPTION OF THE INVENTION

The present invention is a sporting game apparatus that incorporates the strategy of American football into a recreational parlour game, such as shuffle board, billiards, foosball or air hockey. As depicted in FIGS. 1A-1E, the device is crafted by constructing a table like structure, approximately 7 feet long by 3½ feet wide, although other proportions can be crafted without altering the general intent of the invention. Within the table is a planar surface, also constructed out of wood or other sturdy, supportive material that is fastened to the table by a means known to those skilled in the art, and rises approximately 3 inches from the table surface. A border of similar rise is constructed around the table. The top of the planar surface can be covered in wood, laminate, felt, or other material without altering the overall concept of the invention. On the underside of the table are cross-braces and approximately four legs, one at each corner of the game board, extending down from, and securely fastened to the table by screws or other similar fastening means well know in the art, that provide for a stable, level playing surface and elevate the game board off the ground.

Figure 1A:
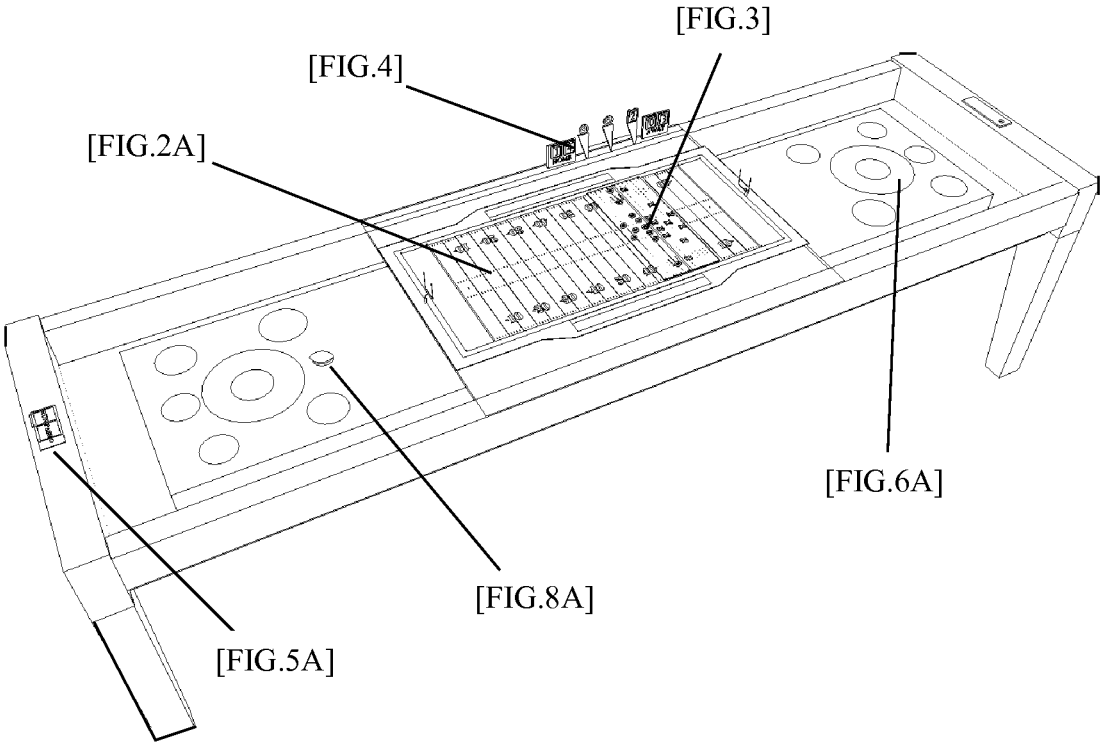
FIG. 1A is an angled overhead perspective view of the present invention showing the game table, the planar playing surface with yardage scoring targets/zones, the replicated football field surface which is secured across and to the top of the game table, the line of scrimmage tracking piece (referred to as "XO player piece"), the down markers, yardage markers, score indicators, and the playing football puck.
Figure 1B:
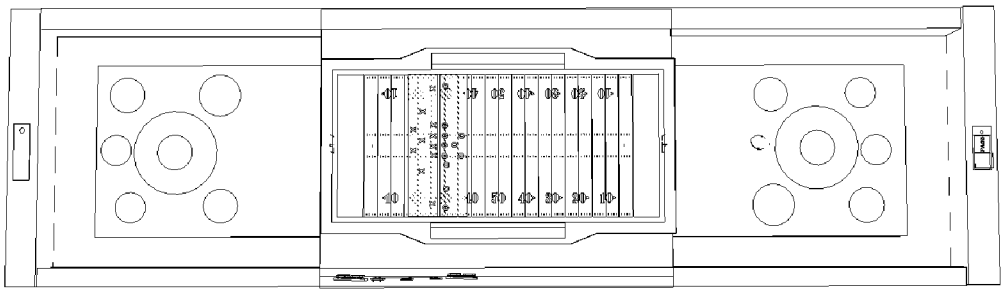
FIG. 1B is a direct overhead perspective view showing the same items indicated in FIG. 1A.
Figure 1C:
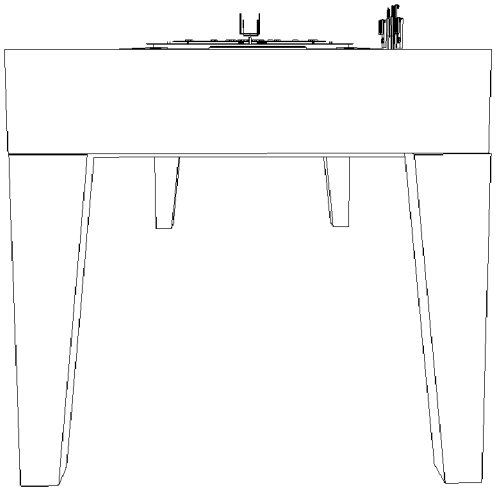
FIG. 1C is an end view of the present invention showing primarily the game table with the legs extending downward.
Figure 1D:
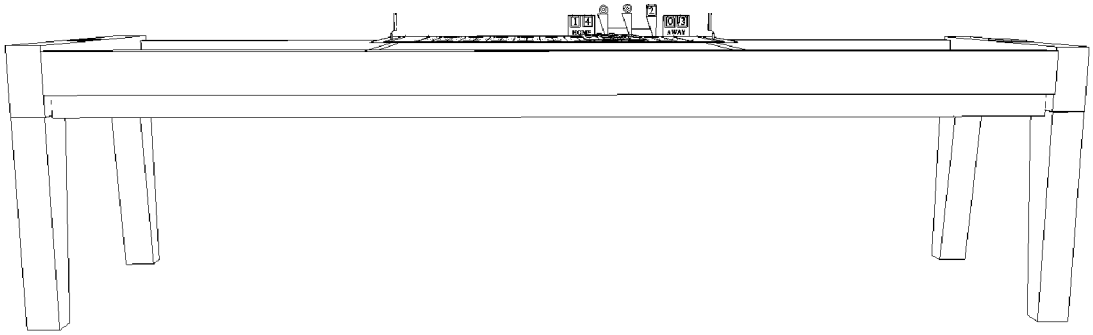
FIG. 1D is a side view of the present invention showing primarily the game table with the legs extending downward.
Figure 1E:
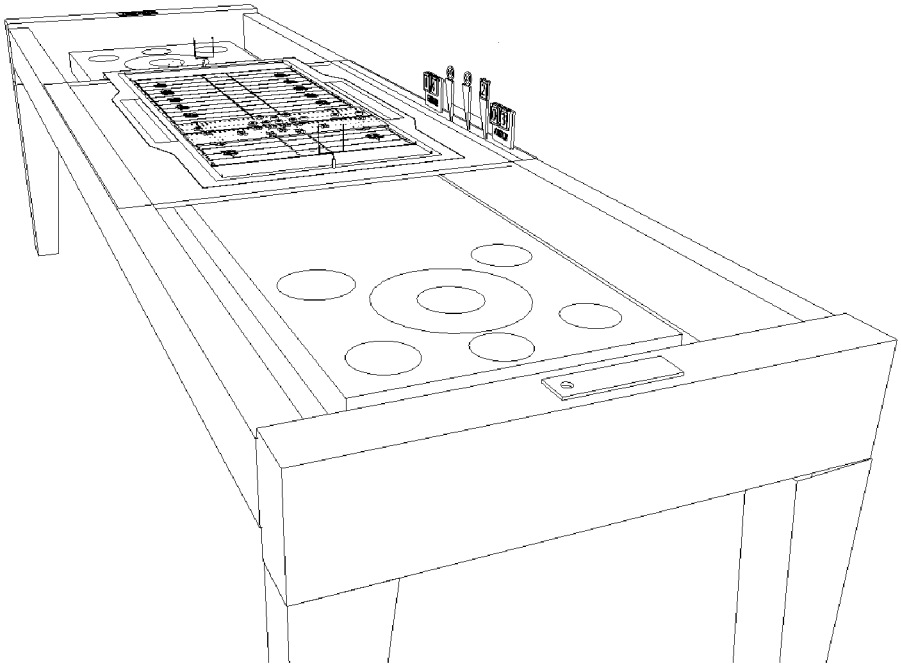
FIG. 1E is an angled, overhead end view perspective of the present invention, as shown in FIG. 1A, intended to show the placement of the replicated football field surface on top of the game table.
Figure 2A:
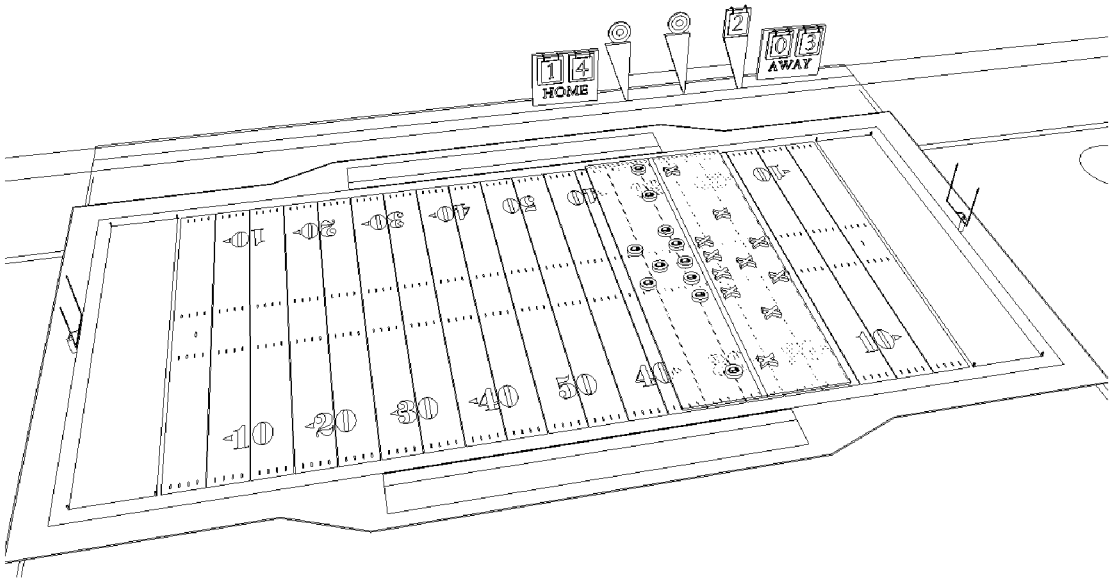
FIG. 2A is an exploded view of the simulated football field piece, also showing closer views of the down markers, yard markers, score indicators and the XO player piece.

As depicted in FIG. 2A, a piece made of wood, laminate, plastic, metal, or other rigid material, painted, printed, or covered in a material designed and marked to scale to represent an American football field is fastened across the middle of the game table described above. On this field piece are model goal posts and end zone marking pylons, representative of those that are found on an actual football field and crafted by those skilled in the art of creating such scaled model or toy equipment pieces.

Figure 2B:
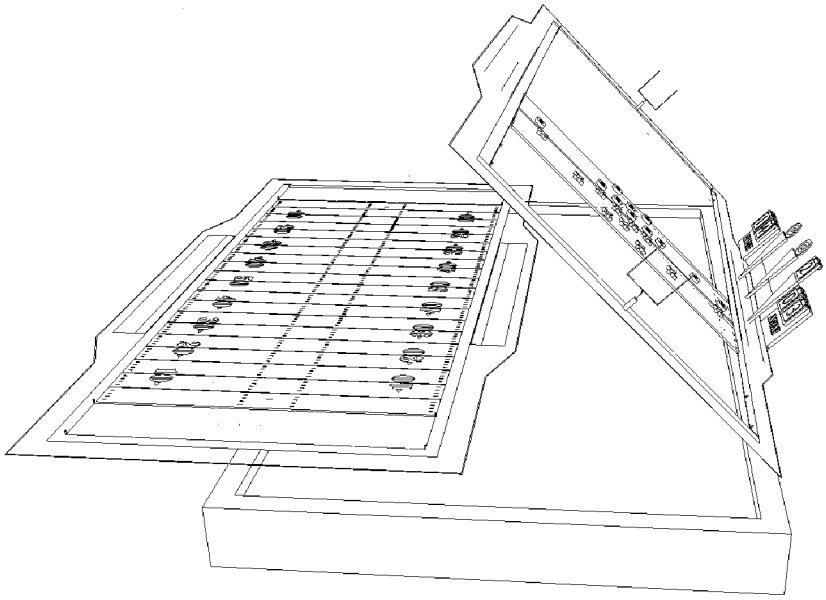
FIG. 2B is an exploded view of the base into which the simulated American football field is placed, with a lid piece to which goal posts, the XO player piece, the yard markers, down marker and score indicators are attached in the open position, and said field simulated being removed.

As shown in FIG. 2B, the simulated football field piece is comprised of a base with a lid into which said field component can be housed and secured. The lid is fastened to the base in a manner known to those skilled in the art so that it can open and close securely, and the XO player piece, the yard markers, down marker, and scoreboard are fastened to the perimeter of the lid component in a manner known to those skilled in the art that allows them to slide longitudinally down the lid. The field component can be removed and replaced with alternate simulated fields.

Figure 3:
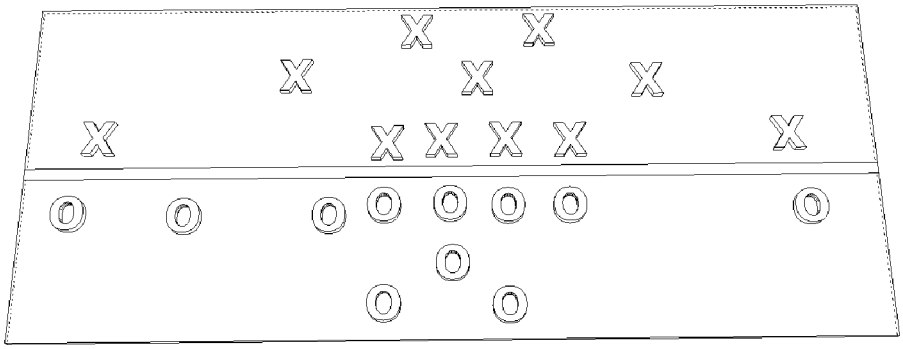
FIG. 3 is an exploded view of the XO player piece.

As shown in FIG. 3 is a rectangular plastic, or other lightweight transparent material, piece marked with "X"s and "O"s in a formation similar to that of players lined up on offensive and defensive positions on a football field, with a graphic line printed down the middle, between the X's and O's, representing the line of scrimmage in a football game that is used to represent from where the ball is snapped on a given down and play. It is understood that other formations or symbols can be utilized on the piece without altering the general scope of the invention. This plastic piece is sized to extend across the latitudinal length of the field piece described above and is secured to such in a fashion so as to allow for the piece to slide over the field piece in a longitudinal direction so that the line of scrimmage indicator can align with the yard markers on the replicated football field piece.

Figure 4:
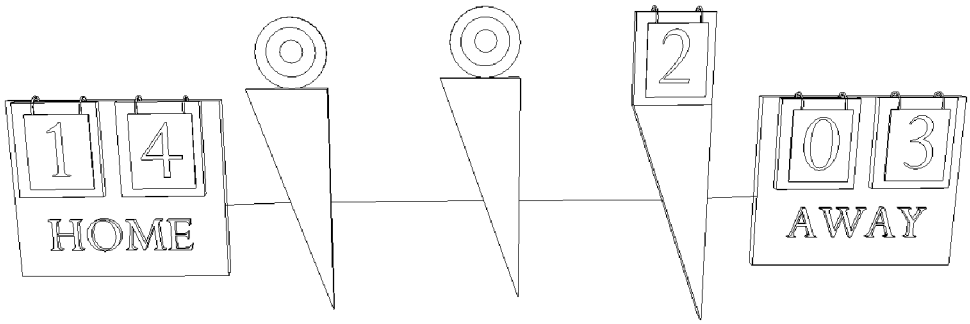
FIG. 4 is an exploded view of the down marker, yard markers, and score indicator piece.

As shown in FIG. 4 is a piece crafted of wood, plastic, or other sturdy material that is designed and scaled to represent the first down yard markers and down markers utilized on the sidelines in an actual football game. In addition, attached are two scoreboard pieces on which the score of the game for a "home" team and an "away" team can be tracked. The mechanism can be attached to either the game table or the field piece and fits into a grooved track that aligns with the yard markers on the replicated football field piece so that it can slide longitudinally down the field. The two yard markers are placed apart from one another at a distance that represents 10 yards on the scaled, replicated football field and the piece is designed so that players can move it longitudinally down the field to mark the distance at which a "first down" is achieved. Numbers on the down marker and scoreboards are designed to rotate, flip, or otherwise change in a manner known to those skilled in the art so that the numbers 0 through 9 can be placed in each numerical location.

Figure 5A:
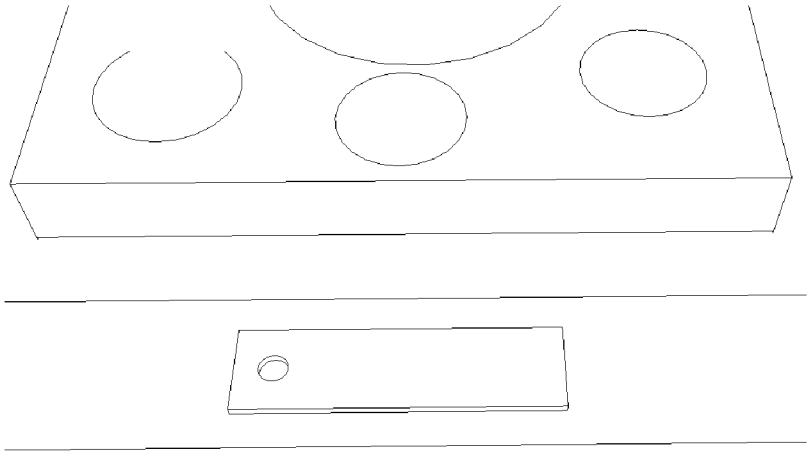
FIG. 5A is an exploded view of the "RUN/PASS" play indicator with the cover slide in the closed position.
Figure 5B:
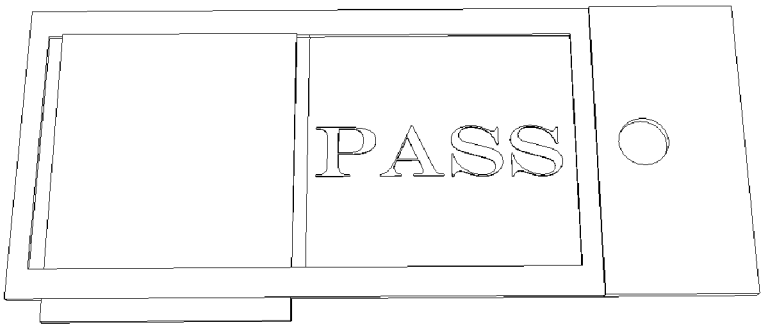
FIG. 5B is an exploded view of the "RUN/PASS" play indicator with the cover slide in the open position, and the inner slide covering the RUN selection.
Figure 5C:
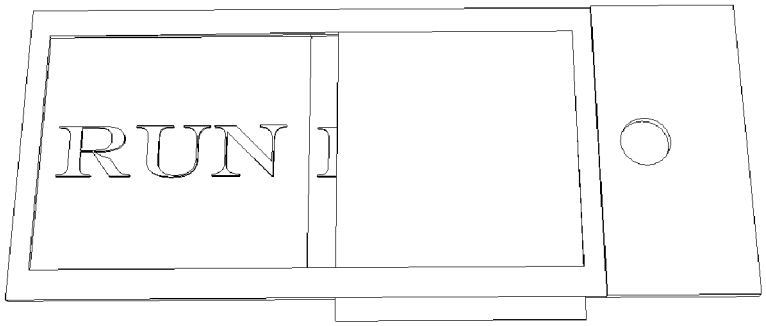
FIG. 5C is an exploded view of the "RUN/PASS" play indicator with the cover slide in the open position, and the inner slide covering the PASS selection.

As shown in FIG. 5A, FIG. 5B, and FIG. 5C is a cover and slide mechanism designed into each end of the game table. The outer cover slides into a receptacle designed into the table, and is used as a lid to cover a "run/pass" indicator slide underneath. An inner cover slide is shown that is used to then cover either the "run" or "pass" selection. Other methods or mechanisms of choosing "run" or "pass", or other play options, can also be designed into the present invention without altering the general scope or intent.

Figure 6A:
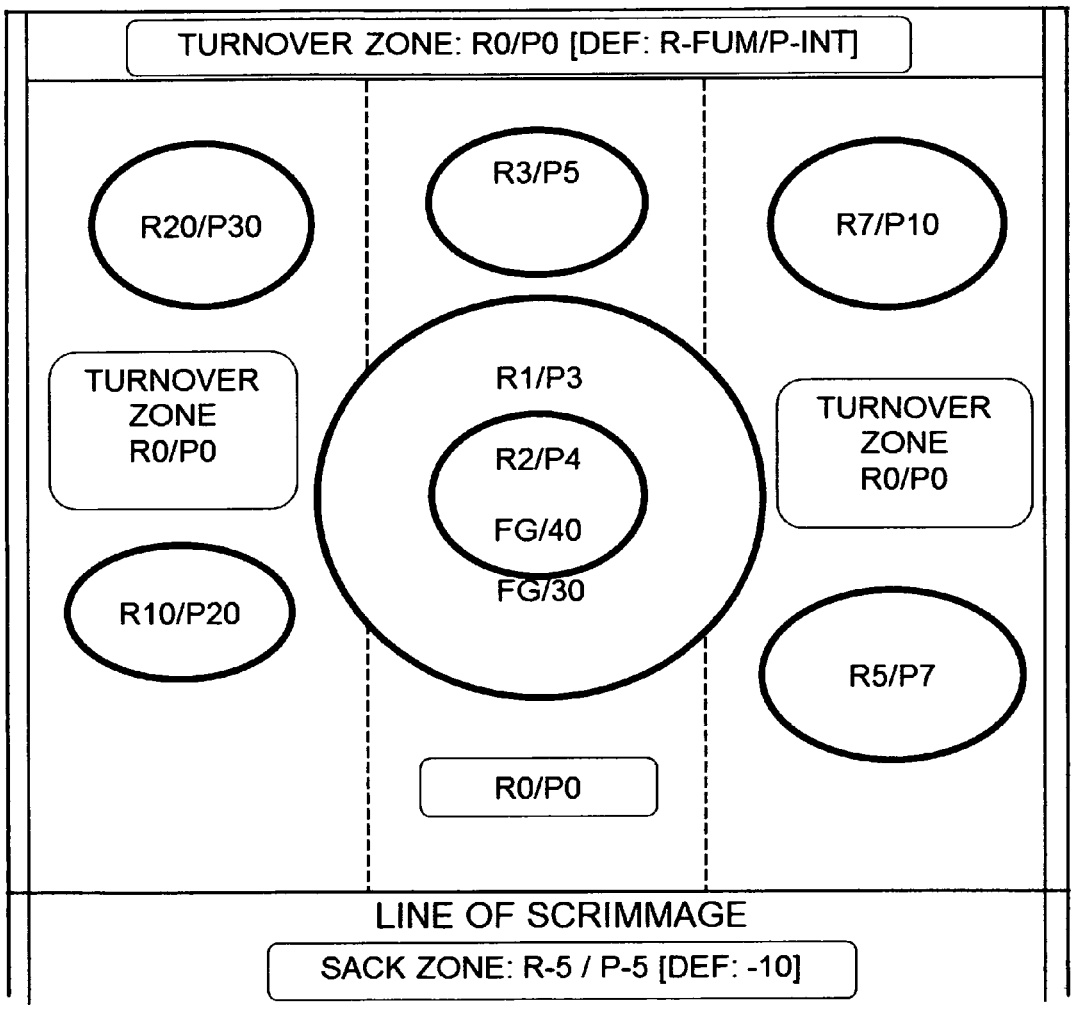
FIG. 6A is an exploded view of the scoring targets and zones on the planar playing surface.
Figure 6B:
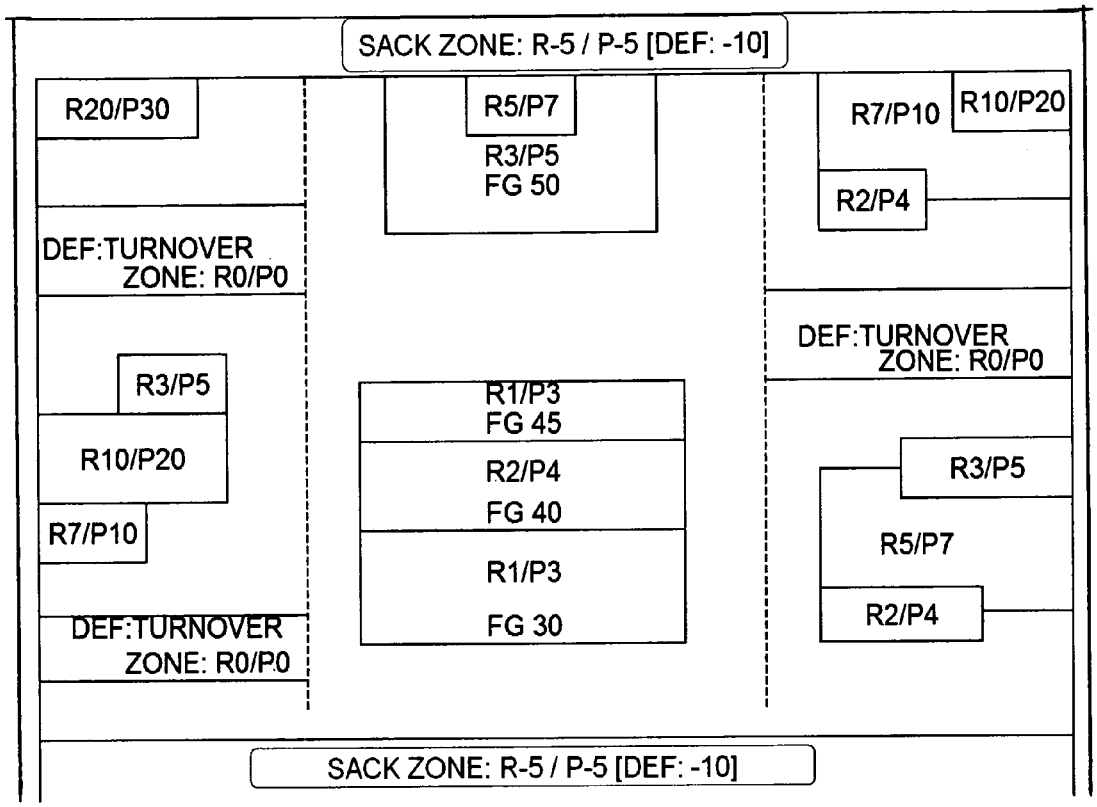
FIG. 6B is an exploded view of an alternate layout of the scoring targets and zones on the planar playing surface.

As shown in FIG. 6A and FIG. 6B are the graphics printed, painted, or otherwise designed on the wood, felt, laminate or other material utilized for the playing surface depicting the scoring and yardage targets and zones. The scoring and yardage targets and zones are of varying sizes in order to create different degrees of difficulty that correspond to the points, yardage, or outcomes that can be obtained on an attempt by the player. The current scoring and yardage zones are shown as ovals and rectangles of differing sizes, with corresponding combinations of points representing variations of yardage gained or lost, however, other sizes and shapes of targets with other variations and combinations of scoring and events that can occur in a play, or down, of American football, located in other positions, can be utilized without altering the general scope of the present invention.

Figure 7:
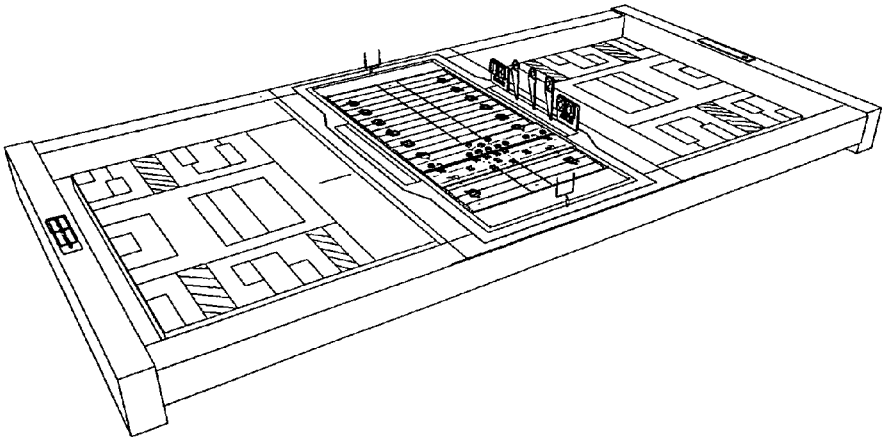
FIG. 7 is an angled overhead perspective of the present invention showing a modified form of the planar playing surface with the alternate scoring targets and zones indicated in FIG. 6B, and an alternate, perpendicular method of securing the simulated American football field to the playing surface.

As displayed in FIG. 7, the present invention can also have the football field piece identified in FIGS. 2A and 2B secured perpendicularly across the game table. Additionally, FIG. 7 shows an alternative layout for the scoring and yardage targets and zones, as depicted in FIG. 6B.

Figure 8A:
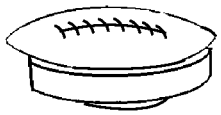
FIG. 8A is an exploded angled top view of the football shaped game piece with a housed rollerball underside.
Figure 8B:
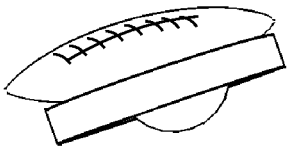
FIG. 8B is an exploded angled side perspective of the football shaped game piece with a housed rollerball underside.

As shown in FIG. 8A, and FIG. 8B, one football-shaped playing piece is crafted from metal and/or plastic and/or other sturdy material(s) know to those skilled in the art, attached firmly to an underlying metal, plastic, or other similar rigid material base, that is designed to securely house an internal rollerball, similar in size to a pinball, that allows said playing piece to roll across the playing surface.

Figure 8C:
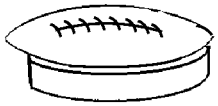
FIG. 8C is an exploded angled top view of the football shaped game piece with a smooth base.
Figure 8D:
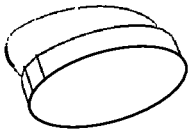
FIG. 8D is an exploded side perspective of the football shaped game piece with a smooth base.
Figure 9:
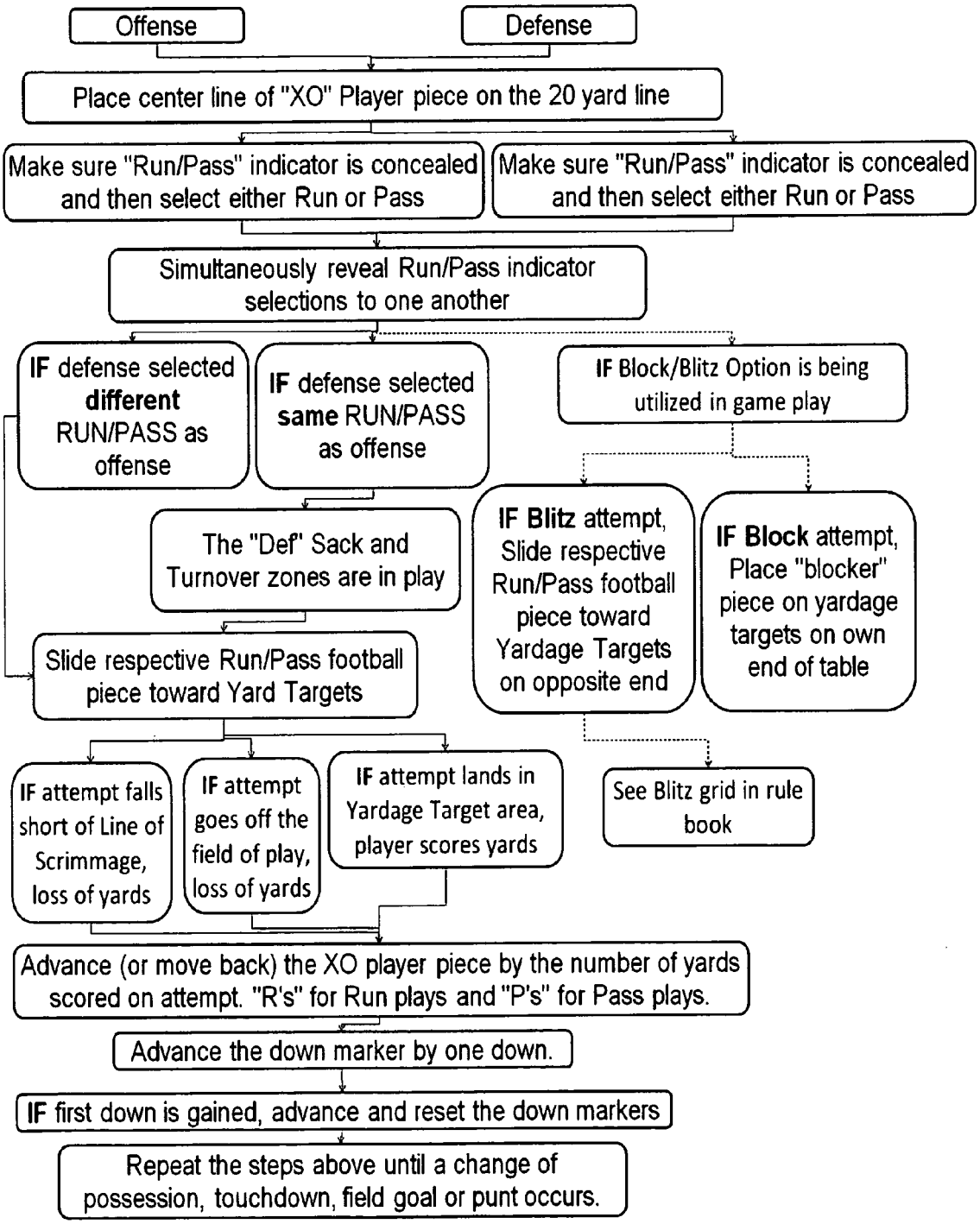
FIG. 9 is a flow chart that outlines the process for following the rules of the game as described herein in the Detailed Description of the Invention section.

As shown in FIG. 8C, and FIG. 8D, one football-shaped playing piece is crafted from metal and/or plastic and/or other sturdy material(s) know to those skilled in the art, and attached firmly to an underlying metal, or other similar rigid material, "puck"-like base that can also be football-shaped, circular, or other shape without altering the overall concept of the invention. The football-shaped top of the playing pieces depicted in FIG. 8A and FIG. 8C is preferably about ¼ inch thick and approximately 3 inches long but could also be of different proportions without changing the overall concept of the present invention. The underlying base components of the playing pieces identified in FIG. 8A and FIG. 8C are preferably 2 and ¾ inches in diameter and 1 and ½ inches thick, but could also be of different proportions without changing the overall concept of the present invention.

The general rules of the game are meant to correspond with the basic rules underlying the sport of American football and are as follows:

Table Football is intended to simulate the strategy of football, with the play and outcome determine by a little bit of skill and a little bit of luck. The rules presented below are the standards, but adaptations that enhance the table football experience are welcomed.

1. LENGTH OF GAME: The game can be timed (ex. most points at the end of 30 minutes) or can be played as the first to a pre-determined number of points (ex. 21 pts.)
2. SCORING: Scoring is the same as real football, although no extra points or two point conversions are necessary (Touchdown—7 pts., Field Goal—3 pts., Safety—2 pts.)
3. LINE OF SCRIMMAGE: At the beginning of the game and the end of any score, play begins on the 20 yard line. Slide the "XO" player piece so that the yellow "line of scrimmage" marker is centered on the 20 yard line.
4. PLAY SELECTION: Each play begins with each player concealing their "RUN/PASS" indicator and then selecting either RUN or PASS for the down. After each player is ready, lift the indicators simultaneously to reveal your selection. IF the defensive player has selected the same type of play for the down as the offensive player, then the "DEF" indicators in the SACK and TURNOVER zones are in play. (Also, see Block and Blitz rule below).
5. GAINING (OR LOSING) YARDS: The offensive player slides either the respective RUN or PASS football piece down the field toward the YARDAGE TARGETS to score yards, if successful on the attempt.
   a. The "R's" represent the number of yards by which to advance the XO player piece on a successful Run Play and the "P's" represent the number of yards by which to advance the XO player piece on a Pass Play.
   b. If the defensive player has correctly chosen the type of play for the given down, then the "DEF" options are in play in the SACK and TURNOVER zones.
   c. If the offensive player does not push the game piece past the LINE OF SCRIMMAGE, then a loss of yards results—the amount indicated in the Sack Zone box.
   d. If the offensive player pushes the football off the field of play, then a loss of yards result, as indicated in the Sack Zone box.
   e. Safety: If a SACK occurs, and it results in the offensive player having to move the XO player piece backwards into his own end zone, so that the line of scrimmage is behind the goal line, a SAFETY is awarded. After a safety, the defense scores 2 points and takes over possession on the 50 yard line.
   f. If the game piece lands on a line, then the game piece is considered to be in the scoring area in which the majority of the game piece lies. If it is "50%/50%", then the game piece is considered to be in the scoring area most advantageous to the offensive player. However, each player is entitled to two challenges per game (see instructions below).
6. "MOVING THE CHAINS": At the end of each play, the DOWN MARKER is advanced by one down and the XO player piece is advanced by the number of successful yards scored (based on the position of the yellow line of scrimmage). On a first down, or during a change of possession, advance/reset the first down markers, just as in real football, in order to correctly relocate the 10 yard marker.
7. 4TH DOWN: On fourth down, the offensive player can elect to "go for it", punt, or kick a field goal. On a missed field goal or an unsuccessful attempt for a first down (or TD) on fourth down, a change of possession results, and the defensive player takes over at the line of scrimmage.
8. SCORING: When the attempt of sliding the game piece into a YARDAGE TARGET on a down results in the successful advance of the XO player piece so that the line of scrimmage marker lands exactly on or beyond the goal line it is considered a score. After a score, increase the value on the HOME or AWAY score dial, reset the XO player piece to the opposite 20 yard line, and the other player starts the next series.
9. CHALLENGES: if the two players cannot agree on the location of the game piece and what area it is in, one player can call for a challenge. Whoever calls for a challenge gets to flip a coin, the other calls "heads" or "tails", and move on with the game play. Each player is allowed two challenges per game.
10. FIELD GOALS: For all field goal attempts, the offensive player simply lets the defensive player know verbally that a field goal is going to be attempted. There are no field goals longer than 50 yards and there is no need to back up the game piece seven yards for kicker placement. However, 10 yards must be added to the distance from the LINE OF SCRIMMAGE to the goal line to determine the length of field goal needed.
    (Ex. If the offensive player is on the 35 yard line, then he is attempting a 45 yard field goal, and thus must score with the 50 yard FG target.).
    Only the three center targets are used for scoring field goals, and landing within a certain target results in a successful attempt for any distance up to that indicated yard amount.
    (For instance, if the offensive player is attempting a 28 yard field goal, but lands in the FG/40 yard target, the field goal is still good)
11. PUNT: For all punts, the offensive player simply lets the defensive player know verbally that he wants to punt. All "punts" are assumed to be 40 yards from the LINE OF SCRIMMAGE. Simply move the XO Player Piece 40 yards and the defensive team takes over. If the offense is on the 39 yard line, or within, of the opposing team's side of the field, then the punt is assumed to be a touchback and the XO player piece is placed on the 20 yard line and the defensive team takes over.
12. "BLOCK" OR "BLITZ" option (for advanced game play): Only when the defensive player chooses the same RUN/PASS type of play on the down as the offensive player's selection, the defensive player may choose to "Block" OR "Blitz" on the attempt.
    To attempt a block, prior to the offensive player's attempt on the down, the defensive player, using the same RUN puck or PASS game piece as the type of play selected, may place one game piece anywhere behind the line of scrimmage in an attempt to discourage or block the offensive player from a certain area.
    To attempt a blitz, at the approximate same time as the offensive player's attempt on the down, using the same RUN game piece or PASS game piece as the type of play selected, the defensive player may choose to push the game piece down to the opposite end of the board in an attempt to land the game piece in one of the "TURNOVER ZONES". The success and outcome of the blitz is based on the following:
    a) If Offense scores yards and Defense lands in Turnover Zone, 0 yards are awarded.
    b) If Offense scores yards and Defense misses Turnover Zone, 2× yards are awarded to Offense.
    c) If Offense lands in an empty space and Defense lands in Turnover Zone, a sack of −5 yards is awarded to the Defense.
    d) If Offense lands in an empty space and Defense misses Turnover Zone, 0 yards are awarded.
    e) If Offense lands in a Turnover Zone, and Defense lands in a Turnover Zone, a Turnover results.

f) If Offense lands in a Turnover Zone, and Defense misses the Turnover Zone, NO Turnover occurs and 0 yards are awarded.

g) If Offense lands in a Sack Zone, and Defense lands in a Turnover Zone, a sack of −10 yards is awarded to the Defense.

h) If Offense lands in a Sack Zone, and Defense misses the Turnover Zone, a sack of −5 yards is awarded to the Defense.

If the defender hits the offensive player's game piece, it is a "penalty" and the offense is awarded 10 yards. (Note: the defensive player is allowed to hesitate slightly, until the offensive player has slid his game piece, but must choose to blitz or not, before the offensive player's game piece reaches his side of the table).

Although the rules described above cover the basic conventions for play, other additions, modifications, and substations are possible without departing from the scope and spirit of the invention.

It is understood that the illustrations of the present invention are by way of example and not by way of limitation, and the scope of the invention is not limited to the exact details shown or described. Potential modifications and alterations may occur to others upon a reading and understanding of this disclosure, and it is understood that the invention includes all such modifications and alterations and equivalents thereof.

In the foregoing description, certain terms have been used for brevity, clearness, understanding, and by way of example, but no unnecessary limitations are to be implied therefrom beyond the requirements of the prior art, because such terms are used for descriptive purposes and are intended to be broadly construed.

What is claimed is:

1. A tabletop sporting game apparatus, comprising:

a) a table having a table surface, a border, and an underside;

b) a planar game board disposed within the table, the planar game board comprising a planar surface disposed above the table surface, wherein the planar surface includes a plurality of scoring targets and a plurality of zones marked thereon;

c) a plurality of legs supporting the planar game board, wherein the plurality of legs are attached to the underside of the table;

d) a simulated American football field piece disposed above the planar game board so that playing pieces may pass underneath the simulated American football field piece as the playing pieces move along the planar surface, the simulated American football field piece comprising a base and a field component disposed within the base;

e) a first play-indicating mechanism attached to a first end of the table and a second play-indicating mechanism attached to a second end of the table, wherein the first and second play-indicating mechanisms are each configured to indicate one of a plurality of play options, the plurality of play options comprising at least a run play and a pass play;

f) a simulated American football yard marker slideably coupled to the simulated American football field piece;

g) a scoreboard coupled to the simulated American football field piece;

h) a down marker slideably coupled to the simulated American football field piece;

i) a simulated American football line of scrimmage marker slideably coupled to the simulated American football field piece; and j) at least one game piece configured to represent an American football.

2. The tabletop sporting game apparatus of claim 1, further comprising wherein each of said plurality of scoring targets represents a number of yards gained or lost, and wherein each of said plurality of zones represents an outcome that can occur in an American football game, wherein the outcome comprises at least one of a turnover and a sack.

3. The tabletop sporting game apparatus of claim 1, wherein the field component is configured to be removed from the base to allow for replacement with alternate field components.

4. The tabletop sporting game apparatus of claim 1, wherein the simulated American football field piece comprises a lid pivotably coupled to the base, and wherein the simulated American football yard marker and the down marker are slideably coupled to the lid.

5. The tabletop sporting game apparatus of claim 1, wherein the simulated American football line of scrimmage marker is slideably coupled to the lid.

6. A method of playing, by two or more players, a simulated American football game, the method comprising:

(a) providing a tabletop sporting game apparatus, the tabletop sporting game apparatus comprising:

(i) a table having a table surface, a border, and an underside;

(ii) a planar game board disposed within the table, the planar game board comprising a planar surface disposed above the table surface, wherein the planar surface includes a plurality of scoring targets and a plurality of zones marked thereon;

(iii) a plurality of legs supporting the planar game board, wherein the plurality of legs are attached to the underside of the table;

(iv) a simulated American football field piece disposed above the planar game board so that playing pieces may pass underneath the simulated American football field piece as the playing pieces move along the planar surface, the simulated American football field piece comprising a base and a field component disposed within the base;

(v) a first play-indicating mechanism attached to a first end of the table and a second play-indicating mechanism attached to a second end of the table, wherein the first and second play-indicating mechanisms are each configured to indicate one of a plurality of play options, the plurality of play options comprising at least a run play and a pass play;

(vi) a simulated American football yard marker slideably coupled to the simulated American football field piece;

(vii) a scoreboard coupled to the simulated American football field piece;

(viii) a down marker slideably coupled to the simulated American football field piece;

(ix) a simulated American football line of scrimmage marker slideably coupled to the simulated American football field piece; and (x) at least one game piece configured to represent an American football;

(b) at least a first one of said two or more players selecting one of said plurality of play options using the first play-indicating mechanism, and at least a second one of said two or more players selecting one of said plurality of play options using the second play-indicating mechanism;

(c) at least one of said two or more players sliding the at least one game piece toward the plurality of scoring targets and the plurality of zones;

(d) awarding at least one of a number of yards, a turnover, and a sack based on where the at least one game piece stops on said game board;

(e) moving said simulated American football line of scrimmage marker, said simulated American football yard marker, and said down marker based on where the at least one game piece stops on said game board; and (f) repeating steps b) through e) above until a simulated first down, a touchdown, a field goal, a punt, a safety or a turnover occurs.

7. A tabletop sporting game apparatus configured to simulate an American football game, comprising:

a planar game board, the planar game board comprising a planar surface, wherein the planar surface includes a plurality of scoring targets and a plurality of zones marked thereon, wherein each of said plurality of scoring targets represents a number of yards gained or lost, and wherein each of said plurality of zones represents an outcome that can occur in an American football game, wherein the outcome comprises at least one of a turnover and a sack;

a first play-indicating mechanism disposed adjacent to a first portion of the planar game board and a second play-indicating mechanism disposed adjacent to a second portion of the planar game board, wherein the first and second play-indicating mechanisms are each configured to indicate one of a plurality of play options associated with American football, the plurality of play options comprising at least a run play and a pass play; and at least one game piece configured to represent an American football a simulated American football field piece disposed above the planar game board so that playing pieces may pass underneath the simulated American football field piece as the playing pieces move along the planar surface;

wherein the simulated American football piece comprises a base and a field component disposed within the base.

8. The tabletop sporting game apparatus of claim 7, wherein the field component is configured to be removed from the base to allow for replacement with alternate field components.

9. The tabletop sporting game apparatus of claim 7, wherein the simulated American football field piece comprises a lid pivotably coupled to the base.

10. The tabletop sporting game apparatus of claim 9, further comprising a simulated American football yard marker slideably coupled to the simulated American football field piece.

11. The tabletop sporting game apparatus of claim 9, further comprising a scoreboard coupled to the simulated American football field piece.

12. The tabletop sporting game apparatus of claim 9, further comprising a down marker slideably coupled to the simulated American football field piece.

13. The tabletop sporting game apparatus of claim 9, further comprising a simulated American football line of scrimmage marker slideably coupled to the simulated American football field piece.

14. The tabletop sporting game apparatus of claim 7, further comprising:

a table having a table surface, a border, and an underside; and a plurality of legs attached to the underside of the table;

wherein the planar game board is disposed on the table surface.

15. The tabletop sporting game apparatus of claim 14, wherein the first play-indicating mechanism is attached to a first end of the table, and wherein the second play-indicating mechanism is attached to a second end of the table.

16. The tabletop sporting game apparatus of claim 14, wherein a first portion of the simulated American football field piece is attached to a first portion of the border, and wherein a second portion of the simulated American football field piece is attached to a second portion of the border.

* * * * *